US005758821A

United States Patent [19]

Wirthwein et al.

[11] Patent Number: 5,758,821

[45] Date of Patent: Jun. 2, 1998

[54] ELASTIC RAIL FASTENING SYSTEM WITH RAIL SPIKE

[76] Inventors: Udo Wirthwein, Industriestrasse 27, D-97993, Creglingen; Wilfried Bonewitz, Schwabenallee 52, D-12683 Berlin, both of Germany

[21] Appl. No.: 397,117

[22] PCT Filed: Sep. 7, 1993

[86] PCT No.: PCT/DE93/00844

§ 371 Date: Apr. 25, 1995

§ 102(e) Date: Apr. 25, 1995

[87] PCT Pub. No.: WO94/05859

PCT Pub. Date: Mar. 17, 1994

[30] Foreign Application Priority Data

Sep. 7, 1992 [DE] Germany ..... 42 30 063.0

[51] Int. Cl.[6] ..... E01B 9/00

[52] U.S. Cl. ..... 238/366; 238/370; 411/439

[58] Field of Search ..... 238/366, 367, 238/370, 371, 372, 373, 375, 377; 411/439, 451, 456

[56] References Cited

U.S. PATENT DOCUMENTS

| | | | |
|---|---|---|---|
| 747,804 | 12/1903 | Thompson | 238/371 |
| 999,771 | 8/1911 | Forsyth | 238/371 |
| 1,294,778 | 2/1919 | Cutting | 238/371 |
| 2,557,271 | 6/1951 | Fulton . | |
| 2,719,452 | 10/1955 | Jones | 238/371 |
| 3,080,120 | 3/1963 | De Turk . | |
| 3,191,864 | 6/1965 | Moses . | |
| 4,066,212 | 1/1978 | Sonneville | 238/372 |
| 4,134,546 | 1/1979 | Dankert | 238/370 |

FOREIGN PATENT DOCUMENTS

| | | | |
|---|---|---|---|
| 1085859 | 2/1955 | France | 238/377 |
| 1180681 | 6/1959 | France . | |
| 638 994 | 11/1936 | Germany . | |
| 0 393 432 A3 | 10/1990 | Germany . | |
| 93/23623 | 11/1993 | WIPO | 238/377 |

*Primary Examiner*—Mark T. Le

*Attorney, Agent, or Firm*—Cohen, Pontani, Lieberman, Pavane

[57] ABSTRACT

A system for elastically fastening rails mounted on underlying cross ties. The foot of the rail is clamped by elastically fastening metallic rail spikes anchored in the cross tie. The rail spikes have a shaft portion and a head portion eccentrically arranged thereon, as well as a plastic element arranged in an electrically insulating manner. This fastening system also has a component linkable to the spike for impressing a permanent bending moment on the shaft portion in all stress phases and for permanently clamping the rail spike. This type of fastening system is suitable both for wooden and concrete cross ties. This system may also include a dowel to anchor the rail spike within the cross tie. This invention also impresses a permanent bending stress on the shaft of the rail foot, so that the rail spike extraction forces can be set at a higher level than is normally obtained. The whole system is stressed under working load and without vertical load, is electrically insulated against signal current drain and is useful for fixing the rail foot against longitudinal and lateral forces.

14 Claims, 5 Drawing Sheets

ELASTIC RAIL FASTENING SYSTEM WITH RAIL SPIKE

BACKGROUND OF THE INVENTION

1. Field of the Invention

The present invention relates to an elastic rail fastening system for rails mounted on a cross tie, the foot of the rail being clamped by metal rail spikes which are anchored in the cross tie and comprise a shank and a head arranged eccentrically thereon, an electrically insulating plastic element being arranged on the rail spike, as well as a rail spike for such a fastening system.

2. Description of the Prior Art

For the fastening of rails to cross ties, elastic or rigid steel parts, including rail spikes, are frequently used, a large number of differently developed structural parts being required for the elastic transfer of the large horizontal and vertical forces. With respect to rail current systems, particularly signal currents, it has also already been proposed to insulate rail spikes electrically from the rails by plastic parts.

A rail spike fastening of this type is known from U.S. Pat. No. 3,080,120. In that case, a rail spike is seated vertically in a wooden tie. Before the rail spike is driven in, a shaped part of non-deformable steel-hard nylon with fiberglass reinforcement is placed over it providing electrical insulation from the foot of the rail after the spike has been driven in. In this connection, the plastic element preferably does not lie on the cross tie. The flexural wave of the rail produces sudden stresses on the rail spike in a vertical direction with the result that the spike loosens and the clamping is reduced. An ordinary commercial element, for instance an elastic interlayer of plastic, may be placed beneath an intermediate plate or rib plate which bears the rail. Since the spike retains its position after being driven into the wooden tie and the insulating plastic element below the head of the spike is not deformable, in contradistinction to the intermediate layer, vertical stresses are produced when the place of attachment is traveled over, thus leading to a complete loss of the clamping force of the rail attachment. Furthermore, the resting of the head of the spike on the plastic part is not always assured, since the elasticity of the rail spike itself makes it necessary to expect a rebounding back of the head of the spike from the hard plastic part. By the rigid clamping in the wooden tie and the steel-hard plastic element lying above it, no prestressing which could impart additional security to the rail attachment can be obtained in the shank of the spike even when the head of the spike rests on the plastic element.

EP 0 393 432 A2 discloses a rail fastening on ties using a rail spike having a special pressure-distributing plate below its head in which the shank of the spike is to be driven into a concrete or wood cross tie at a right angle to the surface of the foot of the rail. Before the intended position of the head of the rail spike is reached, an elastic plastic element which consists of cold-resistant, high-modular, thermoplastic polyurethane with a compressive strength of greater than or equal to 35 N/mm$^2$ and an elastic pressure deformability of up to 40% is inserted between the head of the spike and the foot of the rail. This type of fastening by rail spike has several disadvantages. The mounting of the rail spike is cumbersome, since the spike must first be driven in for a distance, whereupon the plastic part must be properly placed on, and the foot of the rail may have to be aligned again without it losing its position upon the further driving in of the spike. Furthermore, the arrangement of the rail spike relative to the introduction of the force from a working stress via the rail and the foot of the rail is unfavorable since a tilting of the rail results in an immediate pulling of the spike with a small retention force on the part of the spike.

Rail spikes having a polygonal shank are known, for instance, from German Standards DIN 5911 and 5912 and are made of pressed or forged steel. The shank is provided on one end with a nose-shaped head and on its other end with a wedge tip.

SUMMARY OF THE INVENTION

Starting from this prior art, the object of the invention is to propose an elastic rail fastening which, under any working stress assures sufficient security against the loosening of the fastening, and particularly the pulling-out of the spike, electrical insulation of the cross tie from the rail, and easy mounting.

These objects are achieved with the present invention as the rail fastening is developed such that a portion which surrounds the rail spike can impress a bending moment, which is permanent in all stress phases, onto the shank and a corresponding clamping force of the rail spike.

The invention is based on the discovery that a tilting moment or a prestressing in the sense of a bending moment which considerably increases the frictional forces between the rail spike and the cross tie as soon as extraction forces act on the spike is to be applied to the shank of the rail spike in all stress phases. The spike is stressed elastically in tension in all stress phases, but no sudden blows which could lead to a loosening of the attachment act on the spike.

This may be achieved by using plastic elements of cold-resistant, high-modular thermoplastic polyurethane or polyamide which are arranged in an electrically insulating manner between the foot of the rail and a part of the head and/or the head and the shank of the rail spike, which elements surround the shank of the rail spike but do not touch the cross tie. The rail spike itself being adapted to be driven vertically into the concrete tie.

The invention makes use, in this connection, of the discovery that only upon the vertical driving-in of the standardized rail spikes and with elastically resilient clamping of the foot of the rail can a permanent bending moment be applied to the shank of the rail. In this connection, it is first of all immaterial whether the elastic plastic element is arranged only under the head and on the foot of the rail or, in order to intercept also horizontal, transverse forces of displacement acting on the rail and use them further in line with the invention, the edge of the foot of the rail is also insulated from the shank of the spike by the same plastic element. In a second case, a precise fixing of the rail in the lateral direction is possible from the start. The plastic element used can be pushed-on before the driving-in of the spike, similar to the system known from U.S. Pat. No. 3,080,120, so that an exact positioning of the insulating and resilient plastic elements is always possible during the mounting of the rail spike.

For uniform distribution of the load, the plastic element is so developed in the region of the shank of the rail spike that initially the head of the spike rests with its largest possible surface on the plastic element before the web contacts the spring ring which is thus developed.

As an advantageous further development of this inventive concept, the plastic element which can be pushed-on can also be fastened on the head of the rail spike, for instance by bonding or pressure clamping of the plastic part or by the spraying on of a suitable layer of plastic.

Finally, as a further development of the inventive concept, the spike can also be provided within an injection molding machine directly with a covering wherein the spike including the resilient plastic part can be sold as a commercial structural part.

For the further improvement of the inventive concept, it is contemplated to arrange a plastic dowel in a wooden or concrete cross tie, by bonding, screwing, or hammering, into which dowel the shank of the rail spike can be driven. Due to the greater elasticity of the dowel as compared with a wooden or concrete part and the possible form locking thereof to the tie and the higher coefficient of friction between plastic and steel of the shank of the rail spike, and form locking between spike and dowel, the extraction force of the rail spike can be further increased. Similarly, due to the resilience of the plastic dowel, the shank can first bend further within the concrete tie before a component of force permits an extraction of the rail spike, while the dowel can scarcely be pulled out due to the even greater frictional lock or form lock with the cross tie.

Furthermore, the dowel increases the horizontal forces which can be transmitted to the cross tie as a result of its slight pressure on the face of the hole due to its shape and dimension. The diameter of the dowel or the number of dowels to be used can be varied depending on the size of the horizontal forces to be expected. The dowel furthermore assures electrical insulation of the tie from the rail even if the head of the rail spike rests directly on the foot of the rail. Thus, the limiting of the electrical conductivity of the fastening of the rail to the cross tie, which is always required today, is satisfied; the signal system is not impaired by short-circuiting via the tie. In cooperation with such a dowel and the electrical base, mentioned below, between the rail and the tie, a rail spike which has several projections in the manner of a cockscomb on at least one side of its shank can be provided for a particularly permanent attachment. The projections can be arranged as slightly spaced pressed or forged hump-shaped elevations also on several sides of the shank, for instance the sides facing towards and away from the rail. It is also possible to stagger the projections with respect to each other, or to arrange them in the lower part of the spike on one side of the shank and in the upper part of the spike on the other side of the shank. Such a constellation also makes it possible to use the rail spike under a selected angle oblique to the axis of the dowel if existing dowels are to be used, or if they have been introduced at an angle into the cross tie.

For special fields of use, spikes with barb-shaped projections can also be used, particularly for difficultly loosenable rail fastenings. The rail spike fastenings provided with attachments seat it without slippage and/or in form-locked manner in the dowels and the elasticity of the fastening can be adjusted by the selection of suitably adapted materials and wall thicknesses for the dowel. In any event, the elasticity of the dowel is greater than, and thus more effective than, that of the spike.

Furthermore, it can be provided in accordance with the invention that the dowel be developed asymmetrically in the part thereof which extends above the cross tie, for instance on the side facing the foot of the rail, offering a resting surface for the foot of the rail. In this way, an exact position of the foot of the rail can be defined between opposite dowels, the dowel holder which faces the foot of the rail can assume a partial function of the plastic element which is otherwise provided and the side of the dowel facing away from the foot of the rail can serve as further support for the elastic shank.

Such a system for fastening rail spikes in the cross tie can also be provided in existing cross ties in the manner that the dowel is inserted into a region of the tie which is not covered by the foot of the rail. With such a method of repair, it is not necessary to remove the rail from its proper position in order to restore the old rail spike fastening. If the material of the cross tie should be damaged at the previous location of the rail spike, such an anchoring of the rail spike, in accordance with the present invention, is the sole possibility for placing the tie, at little expense, back into a useable condition. In such cases, it is known to secure dowels by screwing or bonding; therefore, the use of a repair method such as is known for tie screws is unnecessary here. Should the axis of the existing anchoring to be replaced in the cross tie have an undesired angular deviation, the spikes of the invention which have projections on the shank can also be used here.

Finally, in connection with the invention, the entire elasticity of the rail attachment system can be controlled and precisely adjusted by placing between the foot of the rail and the cross tie, as known per se, an elastic intermediate layer which consists of a material similar to the plastic element, so that the entire fastening will exhibit a calculatable behavior. Such elastic bases are important in particular for a track on a firm supporting layer, but also for beds of ballast in order to be able to precisely adjust the elastic sinking behavior of the rail and the working stress. A rail fastened with rail spikes which is developed in this manner also has a previously unattainable push-through resistance with respect to the tie. In this connection, with the use of the rail spikes with projections on the shank, the entire elasticity can be calculated merely by selection of the acting thicknesses of material and elasticities of the participating plastic elements.

BRIEF DESCRIPTION OF THE DRAWINGS

The invention will be explained in further detail below with reference to the attached drawings, in which.

DETAILED DESCRIPTION OF THE PREFERRED EMBODIMENTS

Figure 1B:
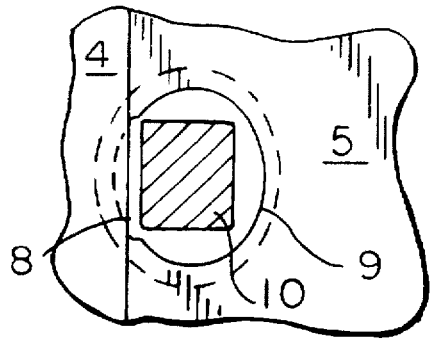
FIGS. 1*a* and 1*b* show a system of fastening by means of rail spikes.
Figure 1A:
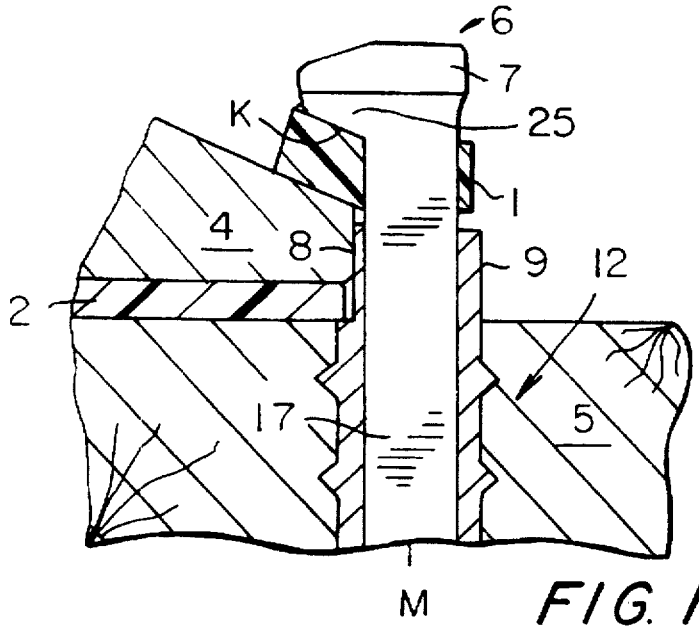
Figure 2:
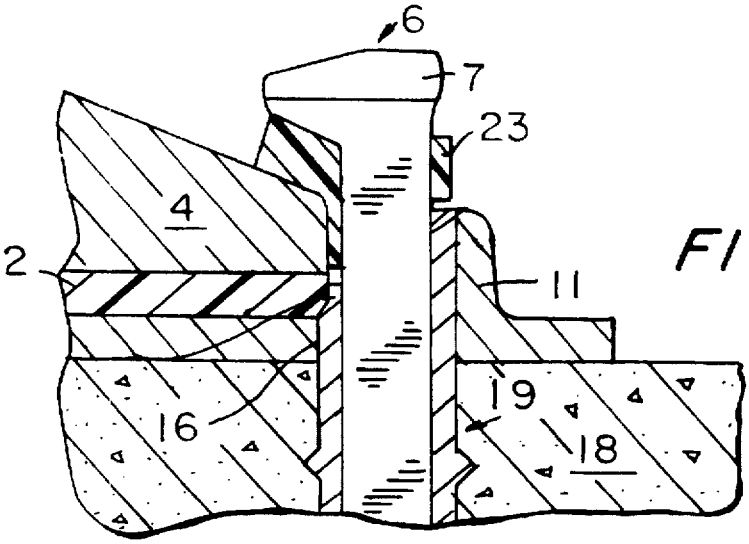
FIG. 2 shows another system of fastening.
Figure 4A:
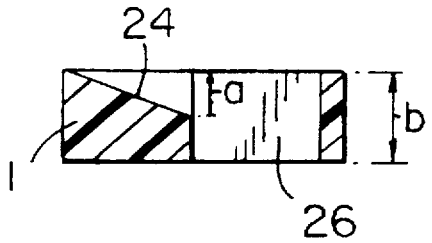
FIGS. 4*a*, 4*b* and 4*c* show two embodiments of a plastic element according to the invention for a fastening system, seen in section and plan view.

FIG. 1*a* shows, a wooden tie 5, an elastic base 2 made of plastic, for instance an elastomer, and a rail foot 4 in its intended position, held by a rail spike 6. On the shank 17 of the steel rail spike 6 there is placed, before it is driven-in, a plastic part 1 (FIG. 4*a*) consisting of high modular, thermoplastic cold-resistant polyurethane, the nose of which part is partially recessed with a resting surface 24 for the transition fillet 25 of the shank 17 into the head 7 of the spike. The rear part of the plastic part 1 comes in this connection into a position below the largest diameter of the spike head so that the neck part of the spike remains free in order to pry out the rail spike 6. Assurance of this is also provided in that the plastic part 1, as shown in FIG. 4a, is developed as an approximately flat plate the hole 26 of which is of slightly smaller size than the spike shank 17 so that a dependable seat of the plastic element 1 on the spike shank 17 is assured. Instead of the plastic element 1, a plastic element 23 in accordance with FIG. 4*b* can also be used, this plastic element 23 has on its side facing the foot of the rail, by which extension the edge of the foot 4 of the rail can be spaced from the spike shank 17 thereby permitting electrical insulation, for instance of signal currents in the steel rail foot 4 from the spike shank 17, as well as an exact positioning of the rail foot 4 relative to the spike shank 17. When using the plastic element 23, however, another dowel is used, similar to the dowel 19 shown in FIG. 2. The dowel 12 of FIG. 1 is seated in a form-locked manner in the cross tie 5 and, on its parts 8 and 9 which extend over the cross tie 18, has a shape which differs from the parts seated within the tie. In the form shown, the dowel side 8 facing the rail foot 4 is of a smaller wall thickness than the rear part 9 of the dowel, its inner contour 10 corresponding approximately to the shank 17 of the spike. Such is clearly seen in FIG. 1*b*. In the intended position of the rail attachment shown in FIG. 1*a*, the center of gravity K of the clamping force lies far outside the axis M of the spike, it being assumed that the plastic element 1 has been compressed by about 20 to 30% of its initial thickness of about 8 to 10 mm and the required restoring force is thus applied. Experiments have shown that such a position leads to a clamping force of about 15 kN. In this connection, the fact is taken into consideration that the compressive strength of the intermediate layer 2 is within the region of about 45 kN. This clamping force exerts a bending moment on the shank 17 of the rail spike 6, leading to a corresponding compressive stressing of the dowel 12. Therefore, a total elastic rail fastening with an extraction force for the spike of more than 25 kN is established. The arrangement of a dowel in the cross tie, regardless of whether a wooden tie 5 in accordance with FIG. 1*a* or a concrete tie 18 in accordance with FIG. 2 is used, the pressure on the face of the hole in the cross tie by the larger dowel is less than a corresponding pressure by a smaller polygonal spike shank. A further advantage consists therein that a polygonal spike shank results in stress peaks in the tie.

FIG. 2 shows another rail fastening in a concrete cross tie 18 on which a rib plate 11 is arranged. On this rib plate 11, in turn, there rests an elastic intermediate layer 2 on which the rail foot 4 rests. A dowel 19 has been introduced into the cross tie 18 through the hole 16 in the rib plate 11; this dowel 19 rests against the edges of the hole 16 in the rib plate 11. The dowel 19 is recessed in the region of its resting surface against the edge of the foot of the rail while on the side facing away from the foot of the rail, it insulates the shank 17 of the rail spike 6 from the rib plate 11. The insulation and resilient clamping of the rail spike 6 against the rail foot 4 is taken over here by a plastic element 23 such as shown in FIG. 4*b*.

Figure 3A:
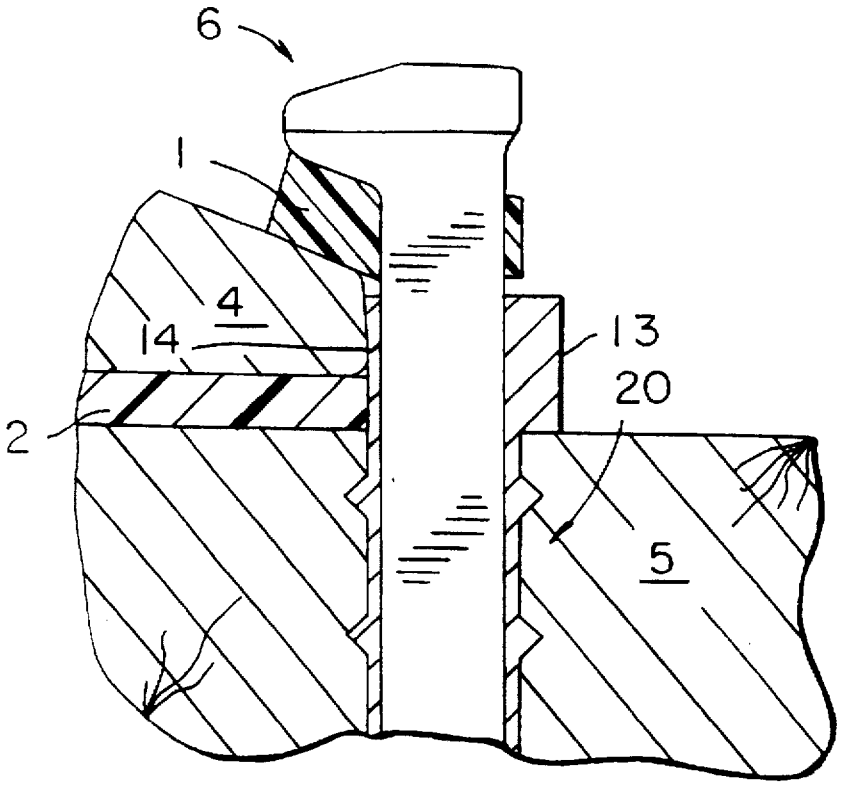
FIGS. 3*a* and 3*b* show a rehabilitated rail attachment.
Figure 3B:
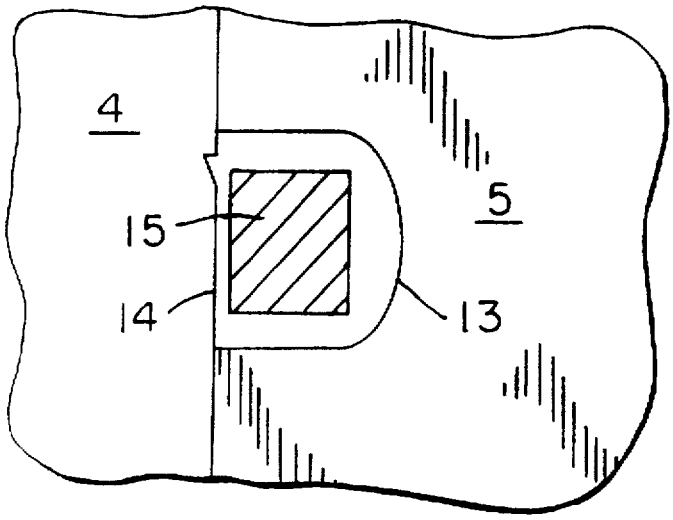

FIG. 3*a* shows a rail fastening similar to FIG. 1*a*, but here the hole for the dowel 20 has been introduced subsequently in the cross tie 5, for instance a wooden tie, and the dowel is seated outside of the place required for the rail foot 4. In the top view (FIG. 3*b*), it can be seen that the dowel is so developed at the shoulder 14, that it, in combination with the collar 13, which limits the depth of insertion or depth of screwing of the dowel 20, serves for securing the position of the edge of the rail foot 4 and for electrical insulation with respect to the shank 17 of the rail spike 6. The plastic element 1 in this case is developed in accordance with FIG. 4*a* and performs solely the function of electrically insulating the head 7 of the rail spike 6 from the rail foot 4 and of elastic transfer of the clamping force to the rail foot 4. The dowel 20 has on its inside a contour 15 for receiving the congruently shaped shank 17 of the rail spike.

Figure 4B:
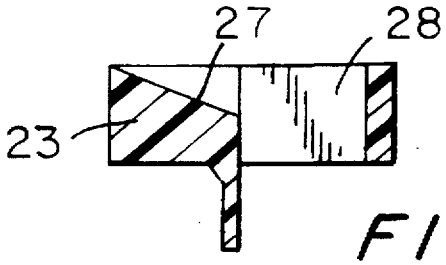
Figure 4C:
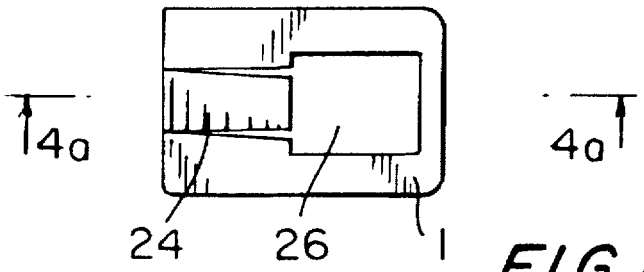

FIGS. 4*a* and 4*b* show, in cross section, two possible shapes of the plastic elements 1, 23, while FIG. 4*c* is a top view of the plastic element 1, with the position of the section A—A in accordance with FIG. 4*a*.

The recesses 24, 27 serve for an anti-twist seat of the fillet 25 and thus of the rail spike 6. The depth a of the recesses with respect to the surface of the plastic elements 1, 23 is greater than the corresponding local thickness of the fillet 25. This results in that the spike 6 first rests on the surface before it reaches the bottom of the recess 24, 27. The thickness b of the plastic element 1 is adapted to the necessary spring path and the clamping force.

Figure 5:
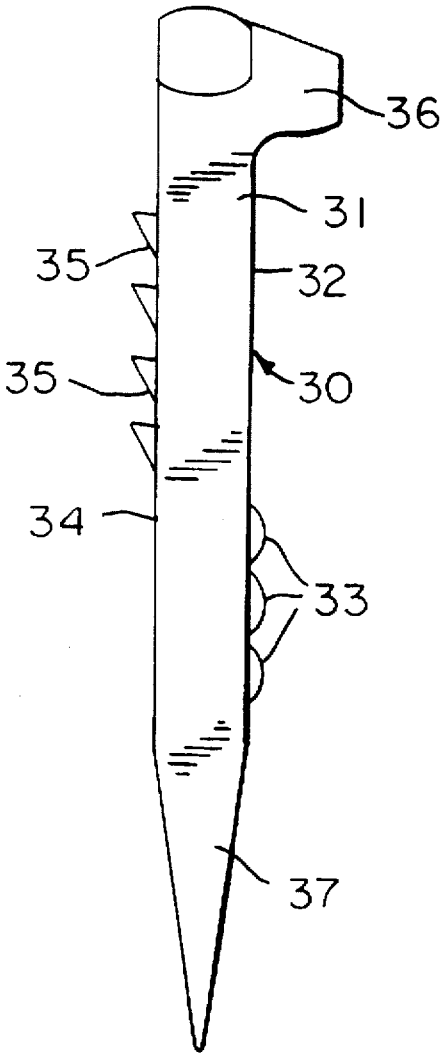
FIG. 5 shows a rail spike with projections on its shank.

FIG. 5 shows a novel rail spike 30 having, for instance, projections 33, 35 on the shank 31. The shank 31, which is of square shape, can be provided with the hump-like projections 33 as shown in FIG. 5 on the side 32 facing the spike nose 36. The projections 33 are indicated here in a position close to the point 37 of the spike. The shank side 34 can also have such projections. As an alternative, or in addition, the projections can also be developed in the form of barbs 35, the position shown on the shank not being the only one possible.

Figure 6:
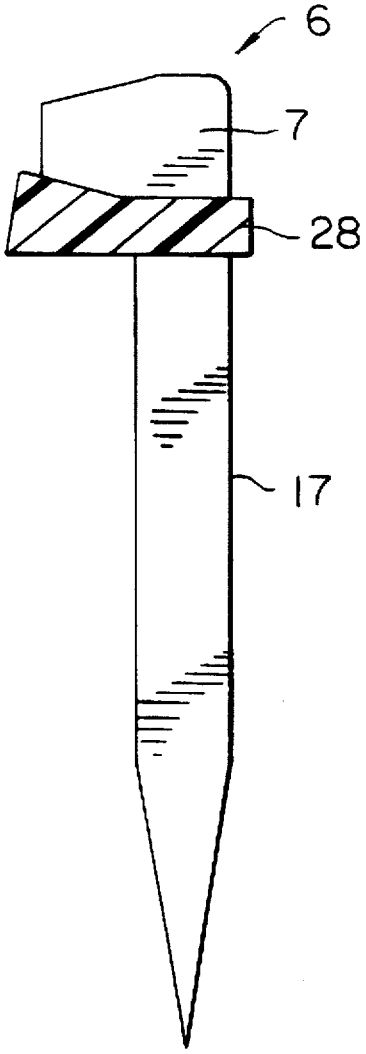
FIG. 6 shows a rail spike including a covering provided by injection molding.

FIG. 6 shows an elastic plastic element including an elastic plastic part which is directly adhered onto the rail spike 6 in form of a covering 28 by placing the spike into an injection molding machine for molding the covering around the spike head 7 and spike shank 17.

We claim:

1. A system for elastically fastening a rail to a cross tie, the system comprising:

a cross tie;

a rail mounted on the cross tie, the rail having a foot portion;

a rail spike for fastening the rail to the cross tie, the rail spike having a shank portion and a head portion, the head portion including a fillet; and an elastic plastic element, arranged about the rail spike, including:

an elastic plastic part arranged about the head portion of the rail spike and between the rail foot and the head portion, the elastic plastic part including a recess which is slightly deeper than the fillet; and an elastic dowel anchored within the cross tie and adapted for receiving the shank portion of the rail spike, wherein the plastic element grips the rail spike in an annular manner so as to impress both a bending moment which is permanent in all stress phases and a permanent clamping force on the shank portion, the elastic plastic element being made of an electrically insulating plastic so as to electrically insulate the rail spike from the rail.

2. The system as claimed in claim 1, wherein the elastic plastic part is fastened to the head portion.

3. The system as claimed in claim 1, wherein the dowel is positioned between the rail foot and the shank portion of the rail spike.

4. The system as claimed in claim 1, wherein the dowel is positioned within a region of the cross tie adjacent the rail foot.

5. The system as claimed in claim 1, further comprising at least one elastic intermediate layer positioned between the cross tie and the rail foot mounted thereon.

6. The system as claimed in claim 1, wherein the elastic plastic part is made of one of a cold-resistant, high-modular, thermoplastic polyurethane and a cold-resistant, high-modular, thermoplastic polyamide.

7. The system as claimed in claim 1, wherein the dowel is elastic and is anchored to the cross tie in one of a form-locked and friction locked manner.

8. The system as claimed in claim 1, wherein the elastic plastic element does not contact the cross tie.

9. The system as claimed in claim 1, wherein the rail spike comprises a shank portion including a plurality of projections extending from at least one side of the shank portion.

10. The system as claimed in claim 9, wherein the plurality of projections are each in the form of barbs and are arranged linearly along the dowel.

11. The system as claimed in claim 9, wherein the plurality of projections are each hump-like in form and are arranged linearly along the dowel.

12. The system as claimed in claim 9, wherein the plurality of projections are both hump-like in form and in the form of barbs and are arranged linearly along the dowel.

13. A system for elastically fastening a rail to a cross tie, the system comprising:

a cross tie;

a rail mounted on the cross tie, the rail having a foot portion;

a rail spike for fastening the rail to the cross tie, the rail spike having a shank portion and a head portion; and an elastic plastic element, arranged about the spike, including:

an elastic plastic part arranged about the head portion of the rail spike and between the rail foot and the head portion; and an elastic dowel anchored within the cross tie and adapted for receiving the shank portion of the rail spike, wherein the plastic element grips the rail spike in an annular manner so as to impress both a bending moment which is permanent in all stress phases and a permanent clamping force on the shank portion, the elastic plastic element being made of an electrically insulating plastic so as to electrically insulate the rail spike from the rail, the dowel being positioned to extend from the cross tie, the portion of the dowel extending from the cross tie having an asymmetrical cross section.

14. The system as claimed in claim 13, wherein a wall of the dowel has a thicker cross section on sides facing away from the rail foot than on a side facing the rail foot, when the dowel is positioned within the cross tie.

* * * * *